US009828967B2

(12) United States Patent
Zheng et al.

(10) Patent No.: US 9,828,967 B2
(45) Date of Patent: Nov. 28, 2017

(54) SYSTEM AND METHOD FOR ELASTIC BREAKDOWN IGNITION VIA MULTIPOLE HIGH FREQUENCY DISCHARGE

(71) Applicant: Ming Zheng, Windsor (CA)

(72) Inventors: Ming Zheng, Windsor (CA); Shui Yu, Windsor (CA)

(73) Assignee: Ming Zheng, Windsor (CA)

( * ) Notice: Subject to any disclaimer, the term of this patent is extended or adjusted under 35 U.S.C. 154(b) by 102 days.

(21) Appl. No.: 14/821,596

(22) Filed: Aug. 7, 2015

(65) Prior Publication Data

US 2017/0254312 A1 Sep. 7, 2017

Related U.S. Application Data

(60) Provisional application No. 62/171,410, filed on Jun. 5, 2015.

(51) Int. Cl.
*F02P 15/00* (2006.01)
*F02M 25/07* (2006.01)

(52) U.S. Cl.
CPC ..... *F02P 15/001* (2013.01); *F02M 25/07* (2013.01)

(58) Field of Classification Search
CPC .. F02P 15/08; F02P 15/10; F02P 15/12; F02P 13/00; H01T 13/22; H01T 13/44; H01T 13/46; H01T 13/467; H01T 15/00
USPC ..... 315/58
See application file for complete search history.

(56) References Cited

U.S. PATENT DOCUMENTS 672,332 A * 4/1901 Roche ..... H01T 13/22 174/152 S
1,191,429 A * 7/1916 Jensen ..... H01J 61/72 123/169 E
1,363,904 A * 12/1920 Nicholson ..... H01T 13/22 123/169 CB
1,385,529 A * 7/1921 Ellis ..... H01T 13/22 123/169 G
1,441,397 A * 1/1923 Chard ..... H01T 13/22 174/152 S
1,538,517 A * 5/1925 Gebhardt ..... H01T 13/467 313/136

(Continued)

FOREIGN PATENT DOCUMENTS

EP 0118789 2/1984
WO WO2007025367 8/2007

*Primary Examiner* — Hieu T Vo
*Assistant Examiner* — Sherman Manley
(74) *Attorney, Agent, or Firm* — IPTechLaw

(57) ABSTRACT

An ignition system includes an ignition coil with a primary winding and a secondary winding having a terminal for providing a high voltage (HV). An electrode arrangement of an igniter includes first and second HV electrodes coupled to the terminal of the secondary winding. The igniter also has at least one ground electrode. A first spark gap is defined between the first HV electrode and the at least one ground electrode, and a second spark gap is defined between the second HV electrode and the at least one ground electrode. A first capacitor is disposed in-line between the first HV electrode and the terminal of the secondary winding and a second capacitor disposed in-line between the second HV electrode and the terminal of the secondary winding of the ignition coil. The ignition system includes a driver module coupled to a terminal of the primary winding, for driving the ignition coil.

16 Claims, 8 Drawing Sheets

(56) References Cited

U.S. PATENT DOCUMENTS 1,560,513 A * 11/1925 Hirsch ..... H01T 13/22 277/637
1,560,515 A * 11/1925 Hirsch ..... H01T 13/22 313/123
2,376,362 A * 5/1945 Kasarjian ..... H01J 29/003 123/169 PH
2,415,138 A * 2/1947 Kasarjian ..... H01T 13/465 123/169 PA
2,487,319 A * 11/1949 Ellis, Jr. ..... H01T 13/22 313/124
3,906,291 A * 9/1975 Schayes ..... B23K 9/0673 307/75
3,956,664 A * 5/1976 Rado ..... H01T 13/462 313/140
4,004,562 A * 1/1977 Rado ..... H01T 13/462 123/169 EL
4,217,873 A * 8/1980 Nishio ..... F02P 9/005 123/596
4,308,487 A * 12/1981 Feaster ..... H01T 13/467 313/136
4,345,576 A 8/1982 Moseley et al.
4,398,526 A * 8/1983 Hamai ..... F02P 9/007 123/143 B
4,548,174 A * 10/1985 Anderson ..... F02P 7/035 123/310
4,557,229 A * 12/1985 Kashima ..... F02P 15/02 123/169 E
4,613,789 A 9/1986 Herden et al.
4,658,185 A * 4/1987 Albrecht ..... H01T 13/54 313/123
4,770,152 A * 9/1988 Mogi ..... F02P 7/035 123/621
5,168,858 A * 12/1992 Mong ..... F02P 15/10 123/605
5,421,312 A * 6/1995 Dawson ..... F02P 15/08 123/620
5,791,320 A * 8/1998 Haban ..... F02P 15/08 123/169 EL
6,167,875 B1 1/2001 French et al.
6,378,513 B1 * 4/2002 Boyer ..... F02P 3/0435 123/625
6,539,930 B2 * 4/2003 Inagaki ..... F02P 9/007 123/655
6,553,981 B1 * 4/2003 Suckewer ..... H01T 13/50 123/620
6,662,793 B1 * 12/2003 Allen ..... H01T 13/50 123/143 R
6,954,074 B2 * 10/2005 Zhu ..... F02P 17/12 324/388
7,467,612 B2 * 12/2008 Suckewer ..... F02P 3/0815 123/143 R
8,342,147 B2 * 1/2013 Nouvel ..... F02P 9/007 123/143 B
2004/0195949 A1 * 10/2004 Hiramatsu ..... H01T 13/467 313/135
2004/0237950 A1 * 12/2004 Metzelard ..... F02P 3/051 123/625
2005/0104495 A1 * 5/2005 Hiramatsu ..... H01T 13/467 313/141
2009/0107439 A1 * 4/2009 Schultz ..... F02P 9/007 123/146.5 R
2009/0134129 A1 * 5/2009 Robarge ..... H05H 1/52 219/121.48
2009/0165764 A1 * 7/2009 Agneray ..... F02P 23/04 123/606
2013/0207545 A1 * 8/2013 Andrea ..... G01R 31/14 315/112
2014/0109886 A1 * 4/2014 Singleton ..... F02P 3/02 123/594
2014/0145624 A1 * 5/2014 Ban ..... F02P 3/01 315/172
2015/0022304 A1 * 1/2015 Skinner ..... H01F 27/28 336/192
2016/0102647 A1 * 4/2016 Hashimoto ..... F02P 9/002 315/283

* cited by examiner

SYSTEM AND METHOD FOR ELASTIC BREAKDOWN IGNITION VIA MULTIPOLE HIGH FREQUENCY DISCHARGE

CROSS REFERENCE TO RELATED APPLICATIONS

This document claims the benefit of the filing date of U.S. Provisional Patent Application 62/171,410, entitled "System and Method for Elastic Breakdown Ignition Via Multipole High Frequency Discharge" to Ming Zheng, et al. which was filed on Jun. 6, 2015, the disclosure of which is hereby incorporated entirely herein by reference.

TECHNICAL FIELD

Aspects of this document relate generally to spark ignition systems. More particularly, particular embodiments relates to a spark ignition system and related methods that achieve reliable combustion results at lean and/or exhaust gas recirculation (EGR) cylinder charges.

BACKGROUND ART

In a spark ignition system an igniter, such as for instance a spark plug, is used to ignite an air-fuel mixture within a combustion zone. As is known in the art, it is desirable to dilute the combustible mixture by increasing the air/fuel ratio, or by increasing the level of exhaust gas recirculation (EGR), to enable operation at higher compression ratios and loads and to achieve cleaner and more efficient combustion.

SUMMARY

In accordance with an aspect of at least one embodiment, there is provided an ignition system, comprising: an ignition coil having a primary winding and a secondary winding, the secondary winding having a terminal for providing a high voltage (HV) signal; an igniter having an electrode arrangement comprising: a first HV electrode coupled to the terminal of the secondary winding; a second HV electrode coupled to the terminal of the secondary winding; and at least one ground electrode, the electrode arrangement defining a first spark gap between the first HV electrode and the at least one ground electrode, and defining a second spark gap between the second HV electrode and the at least one ground electrode; a first capacitor disposed in-line between the first HV electrode and the terminal of the secondary winding of the ignition coil and a second capacitor disposed in-line between the second HV electrode and the terminal of the secondary winding of the ignition coil; and a driver module coupled to a terminal of the primary winding for driving the ignition coil.

In accordance with an aspect of at least one embodiment, there is provided a circuit for use in an ignition system, the ignition system including an ignition coil having a primary winding and a secondary winding, the secondary winding having a terminal for providing a high voltage (HV) signal, an electrode arrangement comprising a first HV electrode coupled to the terminal of the secondary winding, a second HV electrode coupled to the terminal of the secondary winding, and at least one ground electrode, and a driver module coupled to a terminal of the primary winding for driving the ignition coil, wherein the electrode arrangement defines a first spark gap between the first HV electrode and the at least one ground electrode, and defines a second spark gap between the second HV electrode and the at least one ground electrode, the circuit comprising: a first capacitor disposed in-line between the first HV electrode and the terminal of the secondary winding of the ignition coil; a second capacitor disposed in-line between the second HV electrode and the terminal of the secondary winding of the ignition coil; and a first resistor disposed between the first HV electrode and the first capacitor, and a second resistor disposed between the second HV electrode and the second capacitor.

In accordance with an aspect of an embodiment, there is provided an igniter for an ignition system, comprising: a support body fabricated from an electrically insulating material; at least a ground electrode supported by the support body; at least two high voltage (HV) electrodes supported one relative to another by the support body and electrically isolated one from the other and from the at least a ground electrode by the support body, each HV electrode of the at least two HV electrodes having a first end that protrudes from a first end of the support body at a spark forming end of the igniter, and each HV electrode of the at least two HV electrodes having a second end opposite the first end that is contained within the electrically insulating material; an HV terminal having a first end that protrudes from a second end of the support body for connection to a terminal of an ignition coil, and having a second end opposite the first end that is embedded in the electrically insulating material and that opposes the second ends of the at least two HV electrodes; and at least a dielectric element contained within the electrically insulating material, the at least a dielectric element disposed between the second end of the HV terminal and the second ends of the at least two HV electrodes.

In accordance with an aspect of an embodiment, there is provided a method, comprising: providing an ignitable fuel mixture in a combustion zone; providing a plurality of spark gaps, including a first spark gap and a second spark gap, which are disposed within the combustion zone, the plurality of spark gaps being in electrical communication with a secondary winding of an ignition coil, the secondary winding for providing a high voltage (HV) signal during use; providing a first capacitor having a first capacitance in-line with the first spark gap and providing a second capacitor having a second capacitance in-line with the second spark gap, the first and second capacitances being selected for providing a predetermined spark discharge dwell time for the first spark gap and for the second spark gap, respectively; using a driver module, energizing and discharging the ignition coil to provide the high voltage (HV) signal to each one of the first and second capacitors; and producing a plurality of sparks on the plurality of spark gaps including the first spark gap and the second spark gap.

BRIEF DESCRIPTION OF THE DRAWINGS

Embodiments will now be described by way of example only, and with reference to the attached drawings, wherein similar reference numerals denote similar elements throughout the several views, and in which.

DETAILED DESCRIPTION

This disclosure, its aspects and embodiments, are not limited to the specific components or assembly procedures disclosed herein. Many additional components and assembly procedures known in the art consistent with the intended lip suction devices and related methods and/or assembly procedures for lip suction devices will become apparent for use with particular embodiments from this disclosure. Accordingly, for example, although particular embodiments are disclosed, such embodiments and implementing components may comprise any shape, size, style, type, model, version, measurement, concentration, material, quantity, and/or the like as is known in the art for such lip suction devices and implementing components and related methods, consistent with the intended operation.

Operation of internal combustion engines at increased dilution levels gives rise to problems relating to both ignition and flame propagation, necessitating the use of a robust ignition source to ensure successful ignition and stable combustion. One strategy is to enhance the spark discharge power by capacitive discharge, which has been found to be effective for producing robust ignition kernels for lean mixtures. Another strategy involves producing multiple, spatially separated ignition kernels within the combustion zone during a single sparking event, which has shown promising results with lean and/or diluted fuel mixtures.

Unfortunately, conventional spark plugs may not be well suited for use with lean and/or diluted fuel mixtures. As is known in the art, a conventional spark plug ignites the in-cylinder air/fuel mixture by producing an electrical discharge through a spark plug gap. The spark discharge proceeds via the shortest or lowest impedance path, and thus a conventional spark plug with a single central high voltage electrode is capable of producing only one spark channel during a sparking event. Although a spark plug with a single central HV electrode can have multiple ground electrodes, which form multiple virtual spark gaps, such spark plugs can still produce only one spark across the lowest impedance gap during a single spark event. As such, conventional spark plugs are not capable of producing multiple, spatially separated ignition kernels during a single sparking event.

Figure 1:
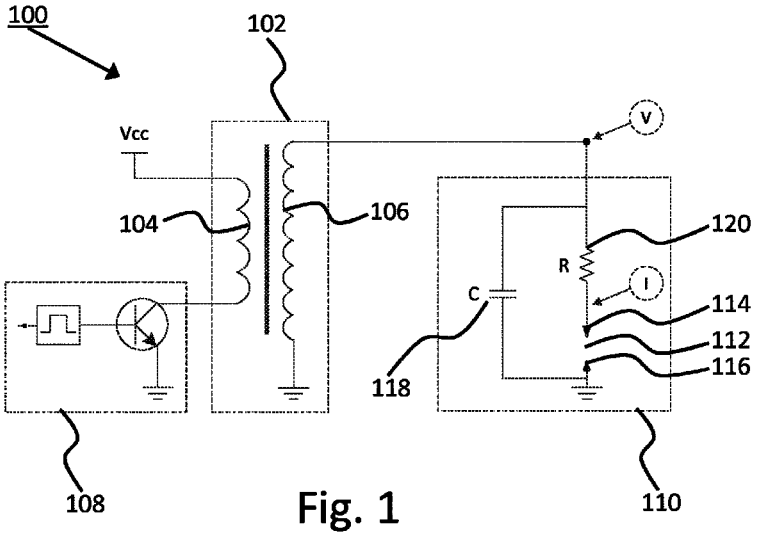
FIG. 1 is a simplified diagram showing a prior art ignition system.

FIG. 1 shows a conventional ignition system 100 based on conventional spark plugs. Ignition coil 102, with primary winding 104 and secondary winding 106, is driven by electronic power drive 108 and supplies high voltage to spark plug 110. A spark is formed when the supplied voltage becomes high enough to cause dielectric breakdown of the air/fuel media in gap 112 between electrodes 114 and 116. Spark plug 110 can be electrically expressed as shown in FIG. 1. A parasitic capacitor 118 is formed, in parallel with the spark gap 112, between spark plug central electrode 114 and cylindrical metal shell ground electrode 116, due to the capacitive ceramic insulator of spark plug 110. The parasitic capacitance is in the range of tens of Pico-farads, and although the capacitance is tiny, it is very important for the initial spark breakdown process because it provides the energy for breakdown. Also shown in FIG. 1 is internal resistor 120, which is embedded in spark plug 110 to restrict spark current and transient ringing noise during the sparking process.

Figure 2:
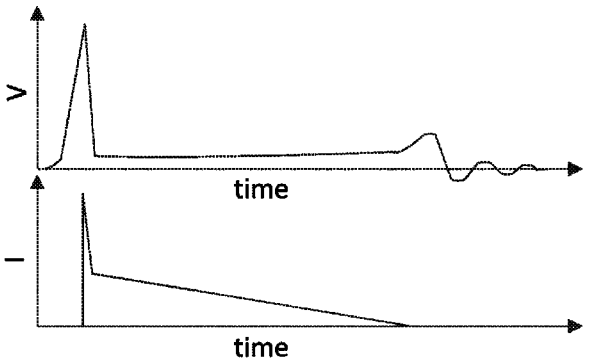
FIG. 2 shows the spark-discharge voltage profile (top) and current profile (lower) for the system of FIG. 1.

Referring now to FIG. 2, shown are the spark-discharge voltage profile (upper) and current profile (lower) for the system of FIG. 1. The spark discharge process is initiated by high voltage electrical breakdown, which is indicated by the high voltage spike in FIG. 2, and is sustained by a relatively low-voltage glowing process. The avalanche breakdown ionizes the air/fuel mixture that is located in spark gap 112 between electrodes 114 and 116 in FIG. 1, causing the media within spark gap 112 to become conductive. The breakdown voltage depends on the gap distance and the gas properties of the media, e.g., density, temperature, and molecular structure. For instance, the higher the density of the media, the higher the required breakdown voltage. The breakdown process is complete on the time-scale of nanoseconds, but with a very high surge current due to the high voltage. As such, the transient electrical power of the breakdown process is high, but the total energy is low due to its short duration. The discharge energy during or right after the avalanche process comes from the tiny parasitic capacitor 118, which is charged by the high voltage prior to break down. After breakdown, the conductive channel between the electrodes 114 and 116 causes the voltage to drop to only a few hundred volts, which is sufficient to maintain the glow discharge.

As is apparent, in the ignition system of FIG. 1 the spark energy is discharged mostly during the relatively longer glow-discharge phase. However, the high power breakdown process is known to be more effective for initiating and sustaining combustion. Therefore it may be beneficial to provide a spark ignition system and related methods that achieve increased breakdown energy and/or breakdown duration, relative to ignition systems that are based on conventional spark plugs.

Figure 3:
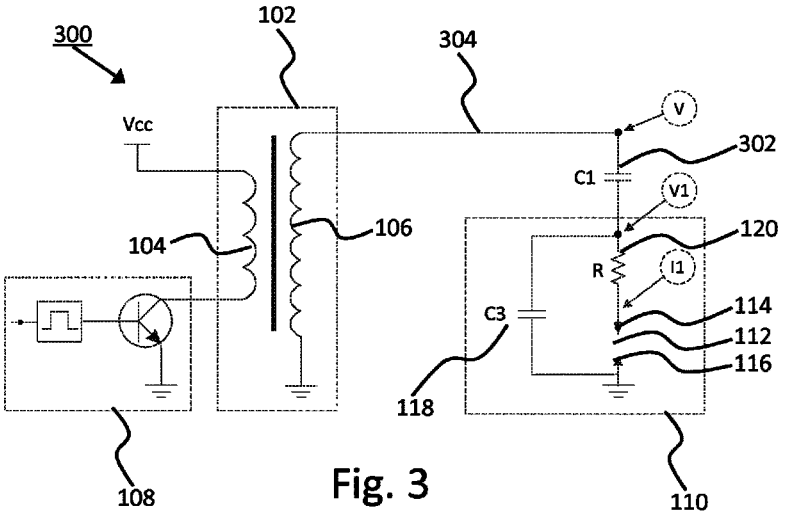
FIG. 3 is a simplified diagram showing an elastic breakdown ignition system with an in-line high voltage capacitor disposed between the ignition coil and the spark plug, in accordance with an embodiment.

Referring now to FIG. 3, shown is an elastic breakdown ignition system 300 with an in-line high voltage capacitor 302 disposed between ignition coil 102 and spark plug 110, in accordance with an embodiment. Resistor 120 functions as a restrictor of the current; it does not fundamentally change the working principle of the ignition system 300. Therefore in the following discussion, for conciseness, resistor 120 is disregarded.

Absent the spark gap 112, the ignition coil secondary winding 106 together with the capacitance of 302 and 118 form a series LC oscillation circuit. Thus, if the spark gap 112 remains "open" (i.e., no breakdown is occurring), the energized circuit will oscillate until the energy is dissipated on the resistive cable 304 and the spark plug resistor 120. Absent a spark being formed, the voltage (V1) after the in-line capacitor 302 follows the voltage (V) oscillation before the capacitor 302, but with a certain degree of phase delay. However, when a spark is formed in the spark gap 112, the voltage (V1) behaves differently due to the spark breakdown.

Figure 4:
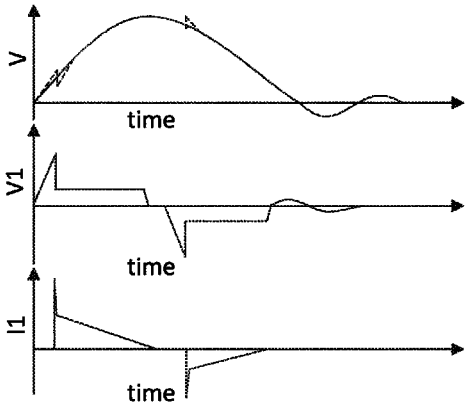
FIG. 4 shows the spark discharge voltage profile measured at V (top), the spark discharge voltage profile measured at V1 (middle) and the current profile (lower) for the elastic breakdown ignition system of FIG. 3.

FIG. 4 shows the spark discharge voltage profile measured at V (top), the spark discharge voltage profile measured at V1 (middle) and the current profile measured at I1 (lower) for the elastic breakdown ignition system of FIG. 3. Before breakdown, both V and V1 increase similarly. The inductor (ignition coil secondary winding 106) charges the in-line capacitor 302 and the parasitic capacitor 118. Once V1 is sufficient for breakdown to occur within the media in the gap 112, V1 suddenly drops to the spark voltage and the spark gap 112 become conductive. The inductor then charges only the capacitor 302. The energy stored in parasitic capacitor 118 is dumped into the spark gap 112 during the breakdown. Although the electrical circuit downstream loop has changed from parasitic capacitor 118 to the spark channel, the overall oscillation profile of V doesn't change, since parasitic capacitor 118 is relatively tiny. That said, a dip on the V profile in FIG. 4 is visible. During the first quarter of the oscillation (rising V), the spark current is sustained through the capacitor 302. The oscillation voltage V reaches the peak while the current becomes zero, then the spark is terminated and the spark gap 112 reverts to open due to of lack of current supply.

In the second quarter of oscillation, when the oscillation voltage V starts to decrease, the current changes direction. At this point capacitor 302 and parasitic capacitor 118 start to charge coil 102, and the current flows back to the inductor (secondary winding 106). Spark gap 112 is now open, and parasitic capacitor 118 starts to pass current and build up voltage. As a result of the current direction change, the voltage across parasitic capacitor 118 changes its polarization. Once the voltage reaches breakdown voltage, gap 112 becomes conductive again and the local electrical loop switches from parasitic capacitor 118 to the spark channel for the second time. In the second quarter of oscillation, the overall current is increasing while the voltage is decreasing. However, in practice the second spark may be instable at the beginning because the current is low relative to the first spark, but the second breakdown is strong because of the energy that is stored in the parasitic capacitor 118.

Some of the ways in which the elastic breakdown ignition system 300 differs from the conventional ignition system 100 are as follows. In the elastic breakdown ignition system 300 the secondary coil voltage oscillation is separated from the spark discharge, resulting in so-called "elastic breakdown," meaning that the spark breakdown is elastic to the coil windings. Additionally, the elastic breakdown ignition system 300 produces more than one spark per sparking event, each spark starting from a breakdown. The amplitude and period of the secondary oscillation is determined by the energizing recuperation (by ignition coil driving control) and the overall capacitance. The resistor 120 controls the spark current. The decay of the oscillation is due to the energy dissipation on the spark discharge and the resistive components in the ignition system. Normally, the first half cycle finishes the production of sparks. The increase of the capacitance of the in-line capacitor 302 decreases the voltage rising rate.

Figure 5:
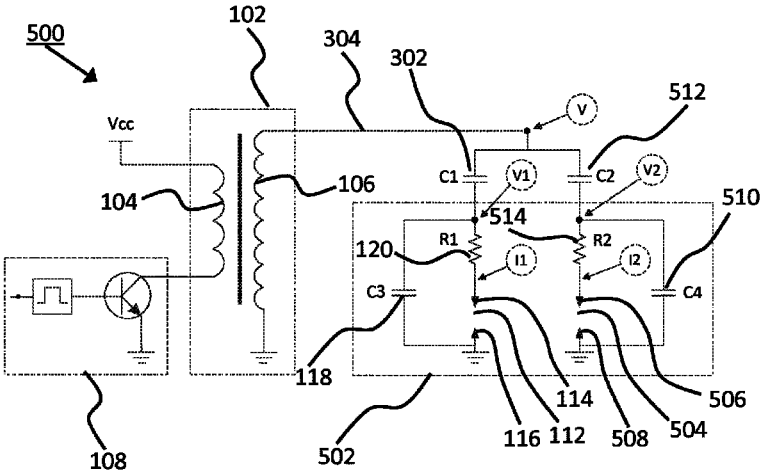
FIG. 5 is a simplified diagram showing an ignition system with an igniter having plural spark gaps, in accordance with an embodiment.

Referring now to FIG. 5, shown is an ignition system 500 including an igniter 502 having a first spark gap 112 formed between electrodes 114 and 116, and a second spark gap 504 formed between electrodes 506 and 508. A first parasitic capacitor 118 is formed, in parallel with the spark gap 112, between electrode 114 and electrode 116, and a second parasitic capacitor 510 is formed, in parallel with the spark gap 504, between electrode 506 and electrode 508, due to the capacitive ceramic insulator of igniter 502. Each spark gap 112 and 504 is connected to the high voltage terminal of the ignition coil 102 via a series shunt capacitor 302 and 512, respectively. The symbols for each spark gap circuit loop have the same meanings as shown in FIG. 1, with the indices representing the spark gap number (i.e., V1/V2 and I1/I2).

Referring still to FIG. 5, it is instructive to consider how the ignition system 500 would function if the multi-pole igniter 502 is coupled to the ignition coil 102 without the in-line capacitors 302 and 512. In such a configuration, only the spark gap 112 or 504 with the lowest impedance would produce a reliable spark discharge. This is because discrepancies between the spark gaps 112 and 504 would lead to different breakdown voltages for the two spark gaps 112 and 504. As such, the spark gap 112 or 504 with the lowest impedance would break down first, pulling the ignition coil voltage down to the spark voltage and thereby preventing breakdown from occurring at the other spark gap 112 or 504.

The in-line capacitors 302 and 512 minimize the discrepancy between the spark gaps 112 and 504, and if the breakdown voltage requirement is relatively low under low-gas density environment, then the breakdown can occur at multiple spark gaps 112 and 504 because the pre-breakdown voltage build-up is equal on both spark gaps. Once breakdown occurs at one of the spark gaps 112 or 504, the high voltage still can be maintained for a very short duration because of the parasitic capacitors 118 or 512, thereby allowing the other spark gap 112 or 504 to achieve breakdown. However, the following current only propagates through the lowest impedance spark gap, and as such only one spark gap forms a continuous and reliable spark after the breakdown for flame kernels. The other spark gap cannot sustain a spark even if discharge channels are initiated by the breakdown, since the energy of the breakdown on the other spark gap comes from the parasitic capacitor 118 or 512 of the other spark gap. Normally, the short and tiny breakdown channel on the other spark gap cannot initiate a flame kernel.

On the other hand, under high gas density conditions a high breakdown voltage is required. The current is high because of the high voltage, and under these conditions the second spark gap cannot reach breakdown once the first breakdown occurs. Thus, under high gas density conditions the chance of breakdown occurring at multiple spark gaps is very low, and normally only one spark can be produced at one of the spark gaps.

Referring still to FIG. 5, with the in-line capacitors 302 and 512 disposed between the igniter 502 and coil 102, the breakdown of each spark gap 112 and 504 is elastic to the ignition coil 102. Therefore, one spark gap can build up high voltage to break down the gap even when the other spark gap is already sparking, such that sparking at each spark gap is independent.

Three operating modes for the ignition system 500 are described below, which depend on the energy supplement, the discrepancy between spark gaps and the capacitors, and the internal resistors.

Mode A

When operating in Mode A there is sufficient energy supplied from the ignition coil and the discrepancy of the spark gaps and the capacitors are low. Optionally, resistances of the internal resistors are high for suppressing the current of each spark discharge, and thus the power of each spark discharge at each spark gap is relatively low. The energy of the breakdowns is negligible compared to the overall energy supply, and the breakdown of the spark gap does not significantly change the overall oscillation.

Figure 6:
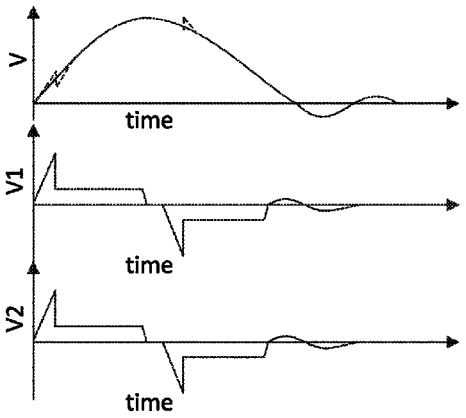
FIG. 6 shows the spark discharge voltage profiles measured at V (top), V1 (middle) and V2 (lower) when the ignition system of FIG. 5 is operating in "Mode A."

When operating according to Mode A, the breakdown of each spark gap is almost simultaneous. After breakdown, the current is almost evenly distributed to each spark gap with a relatively low rate, with the discharge pattern shown in FIG. 4. FIG. 6 shows the spark discharge voltage profile measured at V (top), the spark discharge voltage profile measured at V1 (middle) and the spark discharge voltage profile measured at V2 (lower) for the elastic breakdown ignition system of FIG. 3 during operation in Mode A.

Mode B

When operating in Mode B the discrepancy of the spark gaps and the capacitors are low, but the energy of the breakdowns is considerable compared to the overall energy supply. The breakdown of the spark gap could change the overall oscillation. Optionally, the internal resistors are low and thus the current of each spark discharge is relatively high. The power of each spark discharge on each spark gap is relatively high.

Figure 7:
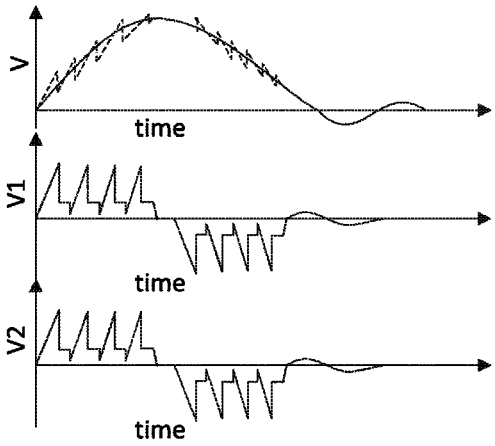
FIG. 7 shows the spark discharge voltage profiles measured at V (top), V1 (middle) and V2 (lower) when the ignition system of FIG. 5 is operating in "Mode B."

When operating according to Mode B, the breakdown of each spark gap is almost simultaneous. After breakdown, the current is almost evenly distributed to each spark gap with a relatively high rate. However, due to the relatively high power draw of each spark, the spark discharge is less sustainable. Thus the spark is terminated after a short duration. Then the energy is accumulated and the coil recharges the capacitors. When the spark gaps return to the breakdown state, the discharges occur again. The discharge on any spark gap in any quarter of oscillation is intermittent instead of a continuous sparking. The duration of each spark depends on the voltage rise rate and the breakdown voltage required. FIG. 7 shows the spark discharge voltage profile measured at V (top), the spark discharge voltage profile measured at V1 (middle) and the spark discharge voltage profile measured at V2 (lower) for the elastic breakdown ignition system of FIG. 3 operating in Mode B.

Mode C

When operating according to Mode C the discrepancy of the spark gaps and the capacitors are high, and the energy of breakdowns is considerable compared to the overall energy supply. The breakdown of the spark gap could change the overall oscillation. Optionally the internal resistors 120 and 514 are low, thus the current of each spark discharge is relatively high. The power of each spark discharge on each spark gap is relatively high.

Figure 8:
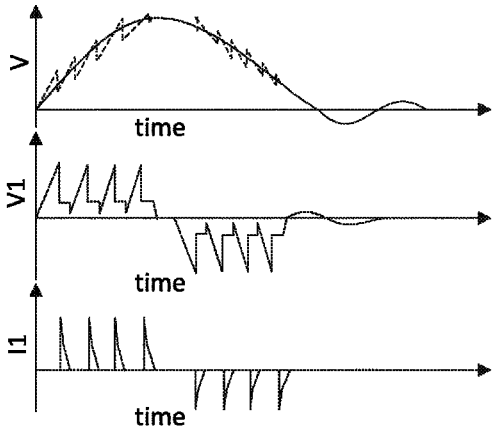
FIG. 8 shows the spark discharge voltage profiles measured at V (top), V1 (middle) and the current profile for gap 1 (lower) when the ignition system of FIG. 5 is operating in "Mode C."
Figure 9:
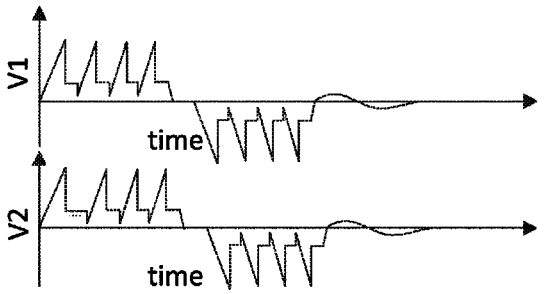
FIG. 9 shows the spark discharge voltage profiles measured at V1 (top) and V2 (lower) when the ignition system of FIG. 5 is operating in "Mode C."

When the elastic breakdown ignition system of FIG. 3 is operating in Mode C, the spark breakdown on each spark gap is not simultaneous. After the breakdown, the current is unevenly distributed to each spark gap. The interactions among the multiple spark gaps can be effective, providing a new multi-spark mechanism. The voltage and current profiles of the spark discharge for elastic breakdown of a multi-pole igniter are illustrated in FIGS. 8 and 9. As shown in FIG. 6 and also illustrated in FIG. 4, the breakdown of each spark gap will cause a sudden drop on the oscillating voltage (V). The disturbance can terminate an ongoing sparking when the voltage drop transmits to the spark gap.

FIG. 9 illustrates the discharge sequence of two spark gaps, i.e., one spark gap is sparking while the other spark gap is preparing to break down. The breakdown of one spark gap terminates the sparking of the other spark gap. The sizes of the spark gaps are similar, but the capacitance of each spark gap loop is different. Initially, the two spark gaps may breakdown almost simultaneously because similar breakdown voltages are required at each spark gap. The duration of each spark is different due to different capacitances. More particularly, the longer duration spark occurs at the spark gap with the higher capacitance or lower resistance. If the discrepancy comes from the variation of the spark gaps, the first spark breakdown will occur sequentially according to the breakdown voltage required for each spark gap. After the first breakdown, the duration of each spark is affected by the breakdown of other spark gap. The spark duration is determined by the voltage rising-rate and the breakdown voltage required for the spark gaps. The sequential breakdown will terminate a sparking gap and slow the voltage rise speed of a pre-breakdown gap.

Because of the dynamics of the spark discharge and the multiple variables of the ignition system, the discharge mode may switch between the afore-mentioned basic modes. For instance, the discharge may start with the Mode A, but after dissipating some energy with Mode A the spark discharge may switch to the Mode B or even Mode C. In reality, the discrepancy of each spark gap is inevitable. For instance, the spark gap may change due to the thermal and chemical aging because of the harsh in-cylinder environment. The discrepancy of media properties between each spark gap is one apparent issue for the stratified in-cylinder charge engines. Moreover, the carbon deposit on the spark plug could also cause the impedance variation of the spark gaps. The existence of the discharge Mode C of the elastic breakdown ignition system actually can tolerate and take advantages by utilizing all those discrepancies.

Based on the same working principles, various different configurations of the elastic breakdown ignition system may be envisaged. Several specific and non-limiting examples of suitable configurations are shown in FIGS. 10-14.

Figure 10:
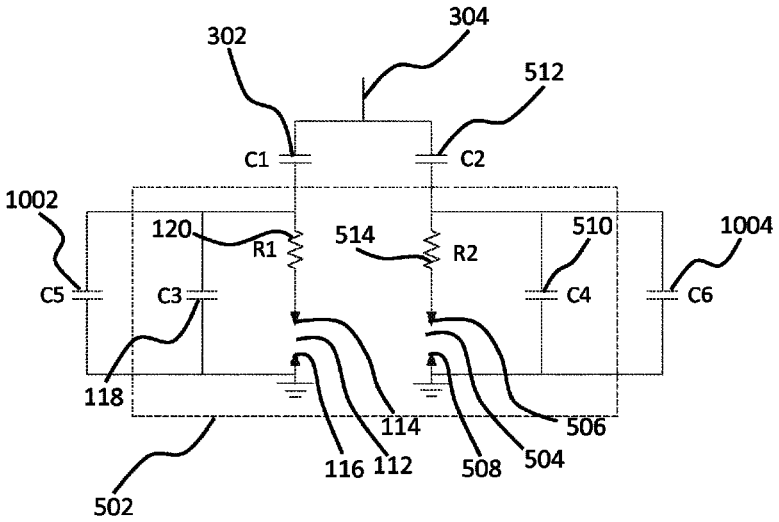
FIG. 10 shows a first alternative configuration for a multi spark gap elastic breakdown ignition system.

The configuration that is illustrated in FIG. 10 is similar to the configuration of the elastic breakdown ignition system shown in FIG. 5, but additional capacitors 1002 and 1004 are disposed in parallel with the spark gaps 112 and 504, respectively. The configuration that is shown in FIG. 10 increases the breakdown energy of each spark gap 112 and 504. Optionally, the capacitors 1002 and 1004 are different.

Figure 11:
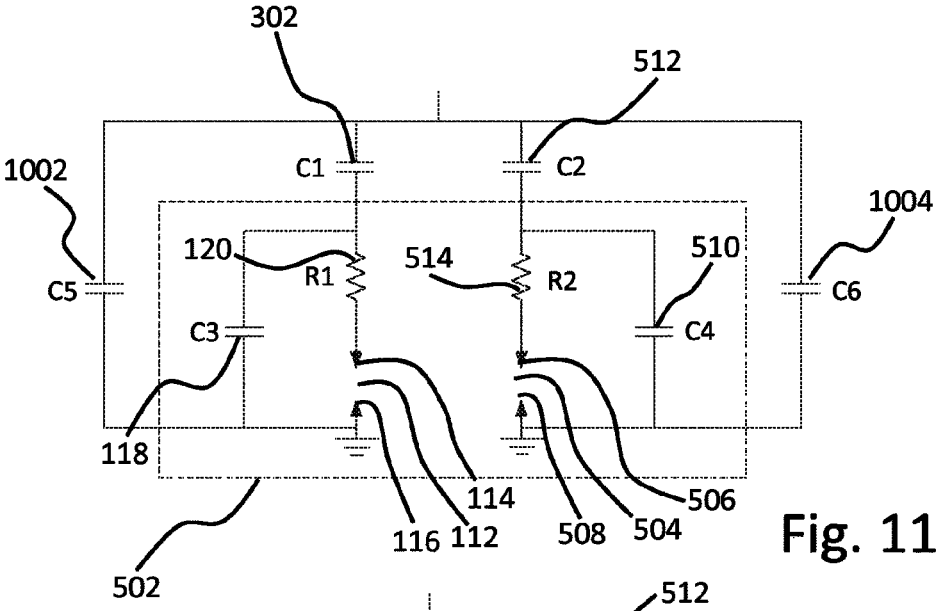
FIG. 11 shows a second alternative configuration for a multi spark gap elastic breakdown ignition system.

In the configuration that is illustrated in FIG. 11, the additional capacitors 1002 and 1004 are disposed in parallel with the secondary ignition coil. The configuration that is shown in FIG. 11 controls the voltage rise rate and stabilizes the overall oscillation.

Figure 12:
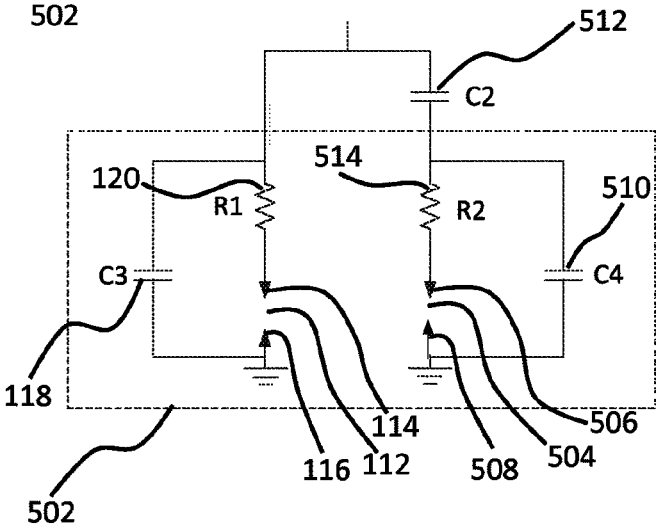
FIG. 12 shows a third alternative configuration for a multi spark gap elastic breakdown ignition system.

In the configuration that is illustrated in FIG. 12, one spark gap 112 is connected to the ignition coil 102 in the conventional way described with reference to FIG. 1. The other spark gap 504 connects to the ignition coil 102 via in-line capacitor 512. The size of the spark gap 112 is bigger than gap 504; thus the spark gap 504 breaks down first and produces a short spark. Subsequently, the voltage of the ignition coil increases until the spark gap 112 breaks down, causing the ignition coil voltage to drop to the spark voltage of the spark gap 112 and terminate the spark at gap 504. In this way, both a conventional spark pattern and a short breakdown spark are produced within one spark-energizing event, via multi-pole distributed discharge.

Figure 13:
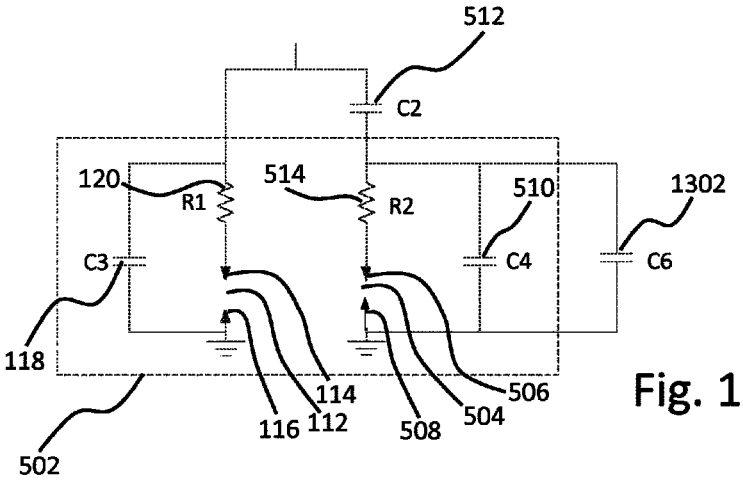
FIG. 13 shows a fourth alternative configuration for a multi spark gap elastic breakdown ignition system.

The configuration shown in FIG. 13 is similar to the configuration shown in FIG. 12, i.e., the size of the spark gap 112 is bigger than the size of the spark gap 504, but an additional capacitor 1302 is disposed in parallel with the spark gap 504 to increase the breakdown energy.

Figure 14:
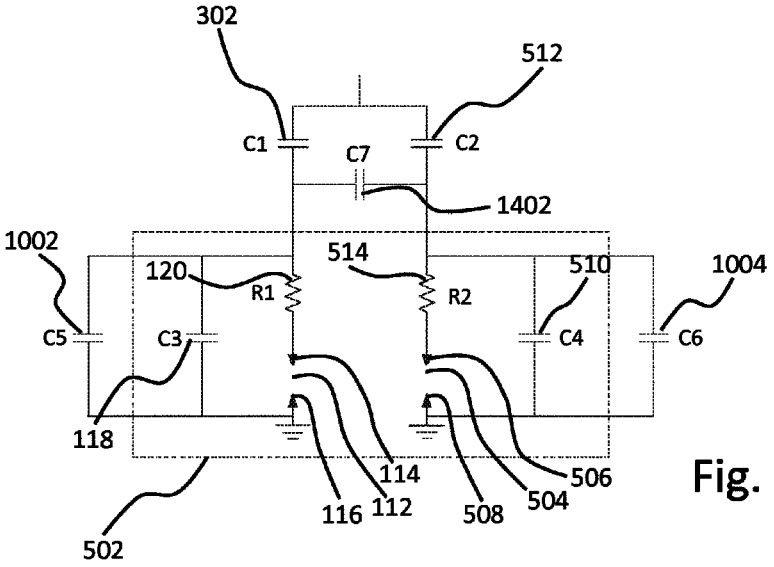
FIG. 14 shows a fifth alternative configuration for a multi spark gap elastic breakdown ignition system.

The configuration shown in FIG. 14 is similar to the configuration shown in FIG. 12, but an extra capacitor 1402 is connected between the electrodes 114 and 506. The purpose of capacitor 1402 is to enhance the interaction between spark gaps 112 and 504. The process during operation can be described as follows. Before any breakdown occurs on the spark gaps, capacitor 1402 is uncharged due to the balanced voltage build-up over two the spark gaps 112 and 504. If breakdown occurs first at spark gap 112, then the capacitor 1402 will be charged by the capacitor 512, the potential between capacitor 512 and resistor 514 will be pulled down, and the breakdown of 502 is further delayed. Subsequently, when breakdown occurs at spark gap 504, the capacitor 1402 will discharge energy to spark gap 504 and increase the spark gap 504 breakdown energy.

Referring now to FIGS. 5 and 10-14, the capacitance of each capacitor and/or the resistance of each resistor in the ignition system can be pre-determined through experiments, so as to produce different spark energies and durations for each spark gap. In this way, ignition systems can be designed and tailored to suit different, specific needs. The capacitance of the in-line capacitors controls the dwell between each spark breakdown and damps the interaction between spark gaps. The capacitance of the capacitors paralleled to each spark gap controls the energy of each spark breakdown. The capacitance of the capacitors paralleled to the ignition coil secondary winding controls the high voltage oscillation amplitude and period, and thus the period of the overall spark duration. The resistance of the resistor coupled between the in-line capacitor and the spark gap in each spark gap loop controls the spark current of the glow phase of each spark discharge following the each breakdown.

There are a variety of ways to couple the in-line capacitors into the systems 300 and 500, and the various configurations shown in FIGS. 10-14. For instance, the in-line capacitors may be embedded in the igniter, or may be embedded in the cable 304, or may be incorporated via an integrated capacitor module, which can be adapted between the ignition coil and the igniter.

Figure 15:
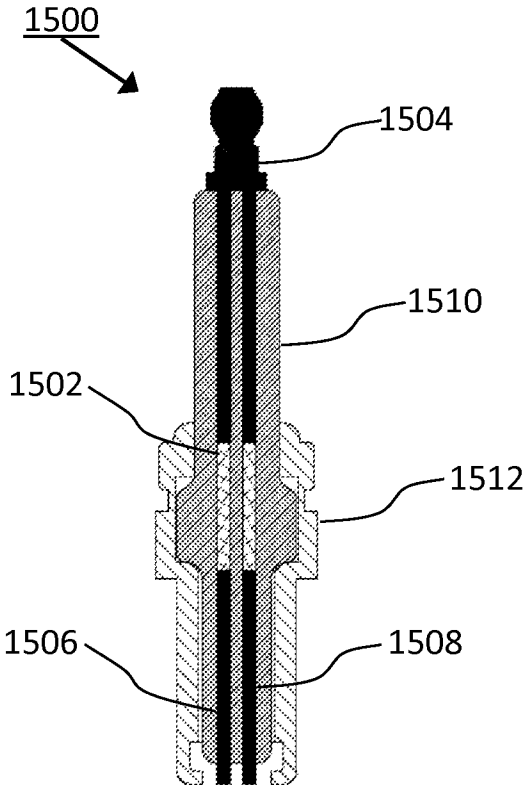
FIG. 15 shows a multipole igniter with embedded in-line capacitors.

FIG. 15 shows an example design of a multipole igniter 1500 with embedded in-line capacitors 1502. Igniter 1500 includes an HV terminal 1504 for connecting the electrodes 1506 and 1508 to the terminal of the secondary winding 106 of ignition coil 102. Insulator 1510 electrically isolates the electrodes 1506 and 1508 one from the other, and from the metal shell ground electrode 1512.

Only two electrodes are shown in FIG. 15, however it is to be understood that the number of electrodes could be two or three or four or more, depending on the actual uses and spark energy needed.

Figure 16:
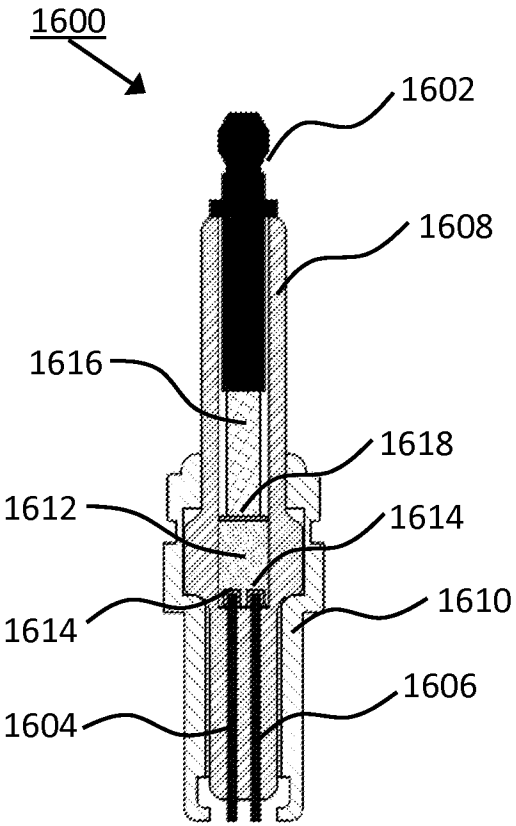
FIG. 16 shows another multipole igniter with embedded in-line capacitors.

FIG. 16 shows another example design of a multipole igniter 1600 with embedded in-line capacitors. Igniter 1600 includes an HV terminal 1602 for connecting the electrodes 1604 and 1606 to the terminal of the secondary winding 106 of ignition coil 102. Insulator 1608 electrically isolates the electrodes 1604 and 1606 one from the other, and from the metal shell ground electrode 1610. The dielectric element 1612 can be formed from a material with dielectric constant higher than alumina's, e.g. Strontium Titanate (ST), Barium Strontium Titanate (BST), Calcium Copper Titanate (CCT). The contact of the electrode and the dielectric material is critical for forming the capacitor. Thus, a thin conductive layer 1614 is coated on the surface of the dielectric element 1612 to enforce the contact. The conductive layer 1614 of each electrode is electrically insulated. A resistor 1616 is embedded in the igniter 1600, between the HV terminal 1602 and a conductive layer 1618 that is coated onto the dielectric element 1612, to suppress electrical ringing and prevent emission of electromagnetic interference noise. In the igniter 1600 multiple discharge electrodes 1604 and 1606 share one dielectric element 1612. By splitting the contact surface 1614, independent capacitors are formed with the individual electrodes 1604 and 1606.

The multi-spark strategy increases the breakdown times and the overall spark duration by energizing the ignition coil multiple times within one engine combustion cycle via electronic driving control. The method can also be used to drive multiple separated single-spark plugs, regardless the spark plug type (resistor or non-resistor), which are mounted in either one cylinder or multiple cylinders. By using one ignition coil and an electronic power driving system, sparks can be distributed to different spark plugs simultaneously with less overall energy compared to a conventional spark plug setup.

The operation mode of the driver module has been described similar to the conventional single spark discharge mode. However, the ignition coil and the driver module can also be configured to operate under high frequency resonant mode, which will continuously produce multiple spark discharges onto multiple spark gaps.

In places where the description above refers to particular implementations of spark ignition systems, it should be readily apparent that a number of modifications may be made without departing from the spirit thereof and that these implementations may be applied to other spark ignition systems.

What is claimed is:

1. An ignition system, comprising:

an ignition coil having a primary winding and a secondary winding, the secondary winding having a terminal for providing a high voltage (HV) signal;

an igniter having an electrode arrangement comprising:

a first HV electrode in electrical communication with the terminal of the secondary winding;

a second HV electrode in electrical communication with the terminal of the secondary winding; and at least one ground electrode, the electrode arrangement defining a first spark gap between the first HV electrode and the at least one ground electrode, and defining a second spark gap between the second HV electrode and the at least one ground electrode;

a first capacitor disposed in-line between the first HV electrode and the terminal of the secondary winding of the ignition coil and a second capacitor disposed in-line between the second HV electrode and the terminal of the secondary winding of the ignition coil;

a first resistor disposed between the first HV electrode and the first capacitor, and a second resistor disposed between the second HV electrode and the second capacitor;

a third capacitor disposed in parallel with the first spark gap and a fourth capacitor disposed in parallel with the second spark gap; and a driver module coupled to a terminal of the primary winding for driving the ignition coil.

2. The ignition system of claim 1, comprising a fifth capacitor disposed in parallel with the ignition coil secondary winding and a sixth capacitor disposed in parallel with the ignition coil secondary winding.

3. The ignition system of claim 2, comprising a seventh capacitor disposed between the first HV electrode and the second HV electrode.

4. The ignition system of claim 1, comprising an electrically insulating material for supporting the first HV electrode and the second HV electrode relative to one another and relative to the at least one ground electrode, and for electrically isolating the first HV electrode and the second HV electrode one from the other and from the at least one ground electrode.

5. A circuit for use in an ignition system, the ignition system including an ignition coil having a primary winding and a secondary winding, the secondary winding having a terminal for providing a high voltage (HV) signal, an electrode arrangement comprising a first HV electrode in electrical communication with the terminal of the secondary winding, a second HV electrode in electrical communication with the terminal of the secondary winding, and at least one ground electrode, and a driver module coupled to a terminal of the primary winding for driving the ignition coil, wherein the electrode arrangement defines a first spark gap between the first HV electrode and the at least one ground electrode, and defines a second spark gap between the second HV electrode and the at least one ground electrode, the circuit comprising:

a first capacitor disposed in-line between the first HV electrode and the terminal of the secondary winding of the ignition coil;

a second capacitor disposed in-line between the second HV electrode and the terminal of the secondary winding of the ignition coil; and a first resistor disposed between the first HV electrode and the first capacitor, and a second resistor disposed between the second HV electrode and the second capacitor; and a third capacitor disposed in parallel with the first spark gap and a fourth capacitor disposed in parallel with the second spark gap.

6. The circuit of claim 5, comprising a fifth capacitor disposed in parallel with the ignition coil secondary winding and a sixth capacitor disposed in parallel with the ignition coil secondary winding.

7. The circuit of claim 6, comprising a seventh capacitor disposed between the first HV electrode and the second HV electrode.

8. An igniter for an ignition system, comprising:

a support body fabricated from an electrically insulating material;

at least a ground electrode supported by the support body;

at least two high voltage (HV) electrodes supported one relative to another by the support body and electrically isolated one from the other and from the at least a ground electrode by the support body, each HV electrode of the at least two HV electrodes having a first end that protrudes from a first end of the support body at a spark forming end of the igniter, and each HV electrode of the at least two HV electrodes having a second end opposite the first end that is contained within the electrically insulating material;

an HV terminal having a first end that protrudes from a second end of the support body for connection to a terminal of an ignition coil, and having a second end opposite the first end that is embedded in the electrically insulating material and that opposes the second ends of the at least two HV electrodes; and at least a dielectric element contained within the electrically insulating material, the at least a dielectric element disposed between the second end of the HV terminal and the second ends of the at least two HV electrodes.

9. The igniter of claim 8, comprising a first conductive layer formed between the second end of the HV terminal and a first surface of the at least a dielectric element and a second conductive layer formed between the second ends of the at least two HV electrodes and a second surface of the at least a dielectric element.

10. The igniter of claim 9, wherein the second conductive layer comprises a first portion disposed between the second surface of the at least a dielectric element and the second end of a first one of the at least two HV electrodes, and a second portion disposed between the second surface of the at least a dielectric element and the second end of a second one of the at least two HV electrodes, the first portion electrically insulated from the second portion.

11. The igniter of claim 10, wherein the at least a dielectric element comprises a first dielectric element disposed between the second end of the HV terminal and the second end of the first one of the at least two HV electrodes, and a second dielectric element disposed between the second end of the HV terminal and the second end of the second one of the at least two HV electrodes.

12. The igniter of claim 8, wherein the at least a dielectric element is fabricated from a material having a dielectric constant higher than the dielectric constant of alumina.

13. The igniter of claim 12, wherein the material is selected from the group consisting:

of Strontium Titanate (ST), Barium Strontium Titanate (BST), and Calcium Copper Titanate (CCT).

14. The igniter of claim 9, comprising a resistor embedded in the electrically insulating material between the second end of the HV terminal and the first conductive layer.

15. A method, comprising:

providing an ignitable fuel mixture in a combustion zone;

providing a plurality of spark gaps, including a first spark gap and a second spark gap, which are disposed within the combustion zone, the plurality of spark gaps being in electrical communication with a secondary winding of an ignition coil, the secondary winding for providing a high voltage (HV) signal during use;

providing a first capacitor having a first capacitance in-line with the first spark gap and providing a second capacitor having a second capacitance in-line with the second spark gap, the first and second capacitances being selected for providing a predetermined spark discharge dwell time for the first spark gap and for the second spark gap, respectively;

providing a first resistor having a first resistance disposed between the first capacitor and the first spark gap and providing a second resistor having a second resistance disposed between the second capacitor and the second spark gap, the first and second resistances being selected for providing a predetermined discharge current on the first spark gap and on the second spark gap, respectively;

providing a third capacitor having a third capacitance paralleled with the first spark gap and providing a fourth capacitor having a fourth capacitance paralleled with the second spark gap, the first and second capacitances being selected for providing a predetermined breakdown energy for the first spark gap and for the second spark gap, respectively;

using a driver module, energizing and discharging the ignition coil to provide the high voltage (HV) signal to each one of the first and second capacitors; and producing a plurality of sparks on the plurality of spark gaps including the first spark gap and the second spark gap.

16. The method of claim 15, comprising providing a fifth capacitor having a fifth capacitance paralleled with the secondary winding of the ignition coil and providing a sixth capacitor having a sixth capacitance paralleled with the secondary winding of the ignition coil, the fifth and sixth capacitances being selected for changing at least one of a period and an amplitude of the HV signal provided by the secondary winding of the ignition coil.

* * * * *